US005975170A

United States Patent [19]

Anguiano

[11] Patent Number: 5,975,170

[45] Date of Patent: Nov. 2, 1999

[54] GOLF BAG COVER DEVICE AND METHOD OF INSTALLATION

[76] Inventor: Xavier Anguiano, 19402 Fiji La., Huntington Beach, Calif. 92646

[21] Appl. No.: 09/087,095

[22] Filed: May 29, 1998

[51] Int. Cl.[6] ..... A45C 5/14; A45C 13/10; A45C 13/36; A63B 57/00

[52] U.S. Cl. ..... 150/159; 190/26; 190/18 A; 190/903; 206/315.4

[58] Field of Search ..... 190/18 A, 903, 190/26; 150/159; 206/315.3, 315.4

[56] References Cited

U.S. PATENT DOCUMENTS

| | | | |
|---|---|---|---|
| 1,863,130 | 6/1932 | Swaim | 190/903 X |
| 2,180,686 | 11/1939 | Lorinovich | 190/903 X |
| 2,471,169 | 5/1949 | Salzberg et al. | 206/315.4 |
| 2,718,251 | 9/1955 | Barbato | 150/159 |
| 2,985,212 | 5/1961 | Dozier . | |
| 3,288,189 | 11/1966 | Davis . | |
| 3,316,951 | 5/1967 | Jacobson et al. | 206/315.4 X |
| 3,530,919 | 9/1970 | May | 206/315.4 |
| 3,724,617 | 4/1973 | Lawler | 190/903 X |
| 3,941,398 | 3/1976 | Nelson | 206/315.6 X |
| 4,657,135 | 4/1987 | Kjose | 206/315.4 X |
| 4,756,394 | 7/1988 | Cohen | 190/903 X |
| 4,951,818 | 8/1990 | Johnson | 190/18 A X |
| 5,105,919 | 4/1992 | Bomes et al. | 190/903 X |
| 5,220,950 | 6/1993 | Cordasco | 150/159 |
| 5,240,106 | 8/1993 | Plath | 190/903 X |
| 5,265,894 | 11/1993 | Dunn | 206/315.4 X |
| 5,274,901 | 1/1994 | Sanders | 150/159 X |
| 5,515,897 | 5/1996 | Fehan | 150/159 |
| 5,657,912 | 8/1997 | Nakayama | 190/903 X |
| 5,671,831 | 9/1997 | Chiu | 190/903 X |
| 5,690,155 | 11/1997 | Millar | 150/159 |
| 5,810,064 | 9/1998 | Sanderson et al. | 206/315.4 X |

FOREIGN PATENT DOCUMENTS

| | | | |
|---|---|---|---|
| 2 254 054 | 9/1992 | United Kingdom | 150/159 |

*Primary Examiner*—Sue A. Weaver
*Attorney, Agent, or Firm*—Knobbe, Martens, Olson & Bear, LLP

[57] ABSTRACT

The present invention is a cover device for use in storing and transporting a golf bag and its contents, and a method of installing said cover device. The top, front, and sides of the cover device are flexible. The lower back section and base are rigid. The cover device has a continuous u-shaped slit along its front and sides near the bottom of the cover device. Under the base, there is at least one wheel and stop. To install the cover device, a user slides the opened cover device over the golf bag, and then pushes the rigid lower back section with his foot under the base of the golf bag.

32 Claims, 5 Drawing Sheets

GOLF BAG COVER DEVICE AND METHOD OF INSTALLATION

FIELD OF THE INVENTION

This invention relates to covers for containing golf bags or the like and more particularly to a soft-sided cover with a rigid lower back portion and rigid base which has a "u-shaped" closing means at or near the bottom of the cover.

BACKGROUND OF THE INVENTION

Cover devices for golf bags are used to protect a golfer's clubs during travel as well as facilitating transport. Many of these covers are bulky, heavy, and cumbersome to use. For example, U.S. Pat. No. 3,530,919 by May, discloses an entirely rigid container. The disadvantages of this type of covers are that they occupy a lot of storage space while not in use, and are inconvenient to carry during travel. Other covers that exist in the art, such as Dunn, U.S. Pat. No. 5,265,894, are made of lightweight material; however, these covers typically have a closure means which run along the vertical axis of the cover. Consequently, the user must open the cover along the entire length, lift the entire golf bag into the cover, and then adjust the cover to properly surround the golf bag before closure.

Thus, a need exists for a golf club cover which not only protects a golf bag containing clubs, but is lightweight, easily stored and transported, and conveniently installed onto the golf club bag.

SUMMARY OF THE INVENTION

An object of this invention is to provide a golf bag cover device which allows a user to store and transport a set of golf clubs contained in a golf club bag. The cover device comprises a flexible top, flexible sides, and a flexible front. The lower back section and base are made from the same flexible material, but also comprise a reinforcing member which renders the lower back section and base rigid. The cover device has a means for rolling and at least one stop under the base to allow a user to tilt the cover device upon the means for rolling and easily roll the cover device by pulling on a handle affixed to the exterior of the cover device. A "u-shaped" slit is located near the base of the cover device which is continuous along the sides and front of the cover device. A closure means, preferably a zipper, closes and opens the slit.

Another object of this invention is to provide a method whereby a user may easily install the cover device onto a golf club bag. The user installs the cover device by first opening the slit on the cover device and sliding the cover device over the top of the golf bag. Next the user grips the cover device and then pushes the rigid lower back section with his or her foot so that the base of the cover device is under the golf bag.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE PREFERRED EMBODIMENT

Figure 1:
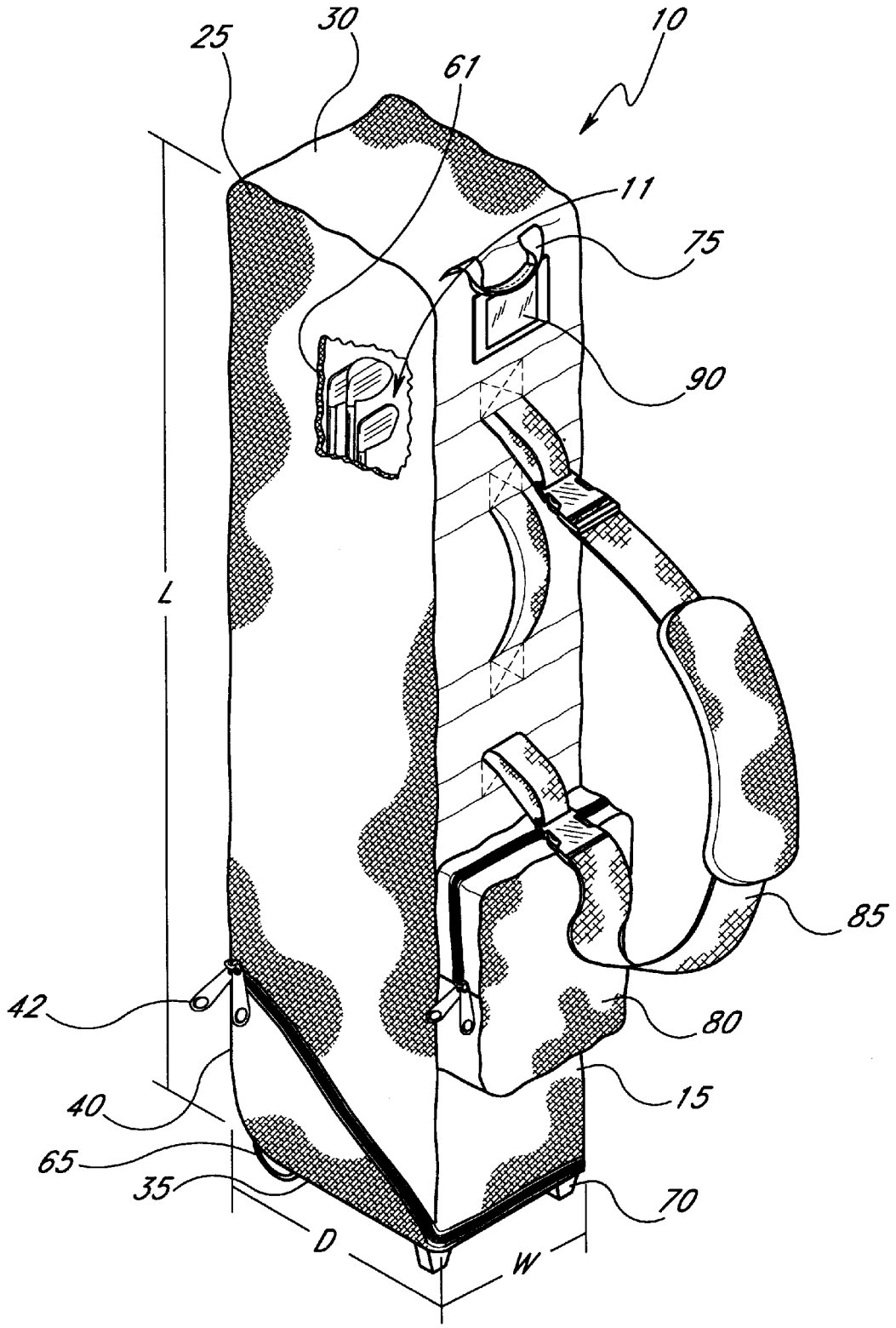
FIG. 1 is a front perspective view of a preferred embodiment of the invention.

The present invention is a bag which is used to facilitate storage and transport of items of a long length. More particularly, the bag is used as a cover device for a golf bag containing a set of golf clubs, although the bag may also be used to store and transport any elongated item, such as, but not limited to: skis, musical instruments, rackets, surfboards, etc. The cover device may be made of any lightweight, durable material such as plastic, canvas, or nylon, and may be made of more than one type of material. Also, the cover device may be waterproof. Because the cover device is mostly soft-sided, it is less expensive than completely hard-sided cover devices. The "u-shaped" closure means located near the base of the cover device provides a novel and convenient method for a user to install the cover device onto the golf bag.

The cover device of the present invention is lightweight and has a flexible front, top and sides. The base of the cover device is rigid and has a means for rolling which assists in transporting the device. The lower section of the back comprises at least one rigid panel. A "u-shaped" slit is located near the bottom of the front and sides of the cover device, and may be opened and closed by a zipper.

A user puts the golf bag with clubs inside the cover device by sliding the opened cover device over the golf club bag. The user then pushes the rigid lower portion towards the golf bag thereby pushing the base of the cover device beneath the base of the golf bag. The top of the rigid panel effectively creates a hinge, or joint, which "swings" the rigid lower portion into place when pushed. This provides an easier method for the user to place his bag into the cover device by avoiding lifting and adjusting of the cover device.

The cover device 10 is a bag with its length, l, greater than its width, w, and depth, d, in order to accommodate the length of a standard set of golf clubs in a golf bag 13. The cover 10 has a front 15, back 20, and sides 25. An opposing top 30 and base 35 are smaller in surface area than the front 15, back 20, and sides 25.

As seen in FIG. 1, the front 15 and sides 25 have a slit 40 continuous along said front 15 and sides 25 wherein the slit 40 extends along the width, w, of the front 15 at or near the bottom of the cover device 10 and extends along each of the sides 25 toward the back 20. While the means for closing the slit 40 preferably comprises a zipper 42, other means is contemplated such as velcro, snaps, buttons, laces, buckles, loops, or hooks.

Figures 3, 3A:
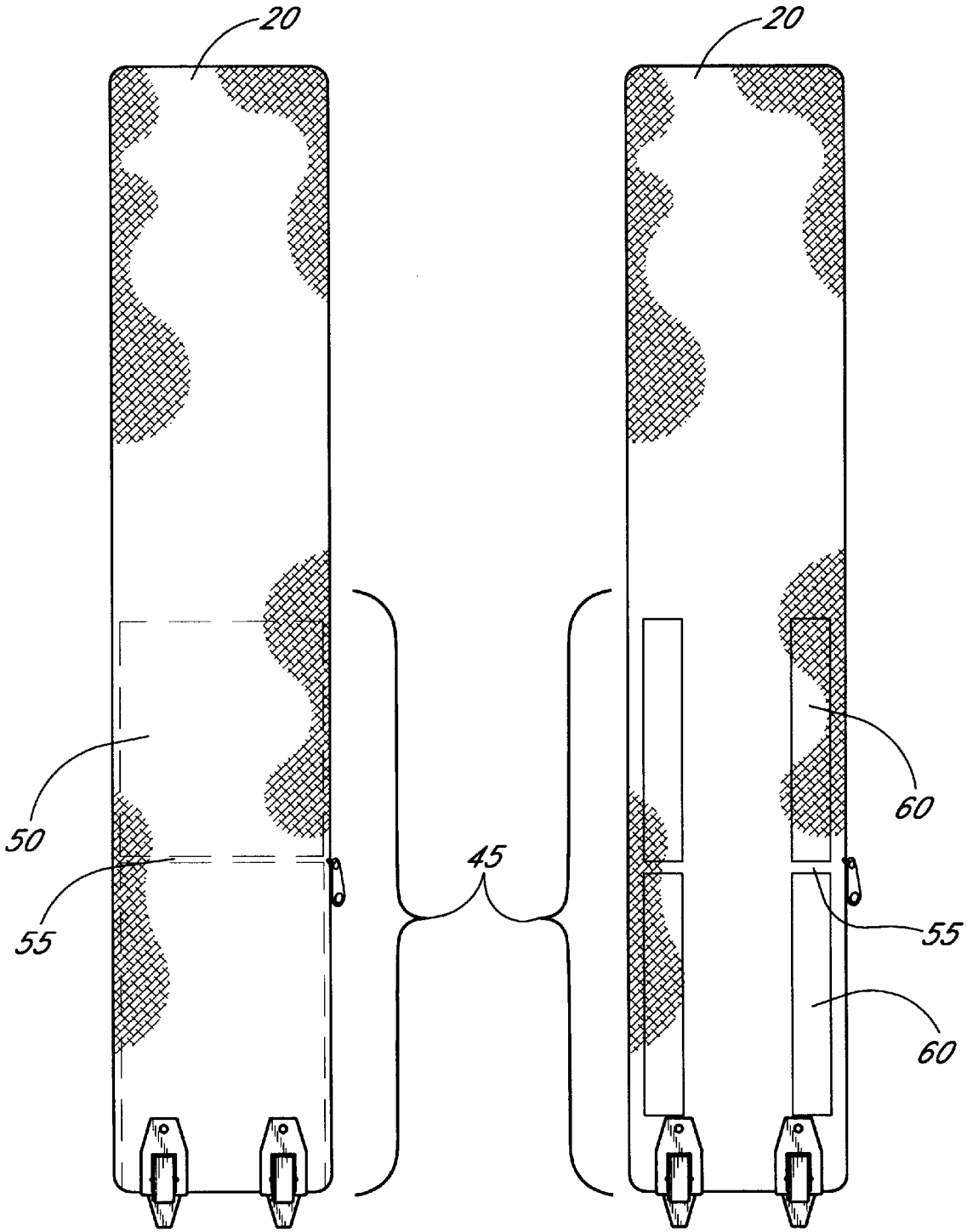
FIG. 3 is a rear view of a preferred embodiment showing two internal rigid panels.
FIG. 3*a* is a rear view of an alternate embodiment showing four internal rigid ribs.

A lower section 45 of the back 20 may be made of the same material as the top, front, and sides, but is reinforced with at least one member which adds stiffness to said lower section 45 (see FIG. 3). The reinforcing member which renders said lower section 45 rigid, may be made of a high density plastic, high-grade cardboard, or other materials of similar stiffness. The stiffness of the lower section 45 is such that a user cannot fold said lower section 45 as easily as said front 15, sides 25, or top 30 is folded. In a preferred embodiment, the lower section 45 comprises two panels 50. A space 55 exists between the two panels 50 which creates a hinge.

In another embodiment, the rigid lower section 45 comprises external or internal ribs 60 along the back's 20 outer edges (see FIG. 3*a*). There will typically be four ribs 60. Each rib 60 lies on the back's 20 outer edges and are vertically oriented. The two ribs 60 on each side will be spaced a small distance 55 apart. Like the panels 50, the space between the vertical ribs 60 creates a hinge.

The portion of the cover device 10 other than the lower rigid section 45 and the base 35 may comprise padding 61 to protect the golf bag 13 and its contents. In a preferred embodiment, the padding is located in the top 30, and portion of the sides 25, back 20, and front 15 near said top 30 in order to protect golf club heads 11. The padding may be made of a sponge-like material, cotton, or other similar materials of a sufficient thickness to provide cushioning if the cover device 10 were to impact another object.

The base 35 of the cover device 10 also comprises a reinforcing member 36 in order to support the weight of the golf bag 13 and its contents. A means for rolling and at least one stop 70 are attached under the base 35. While the means for rolling the cover device 10 preferably comprises at least one wheel 65, other means is contemplated such as casters, rollers, or tracks. The at least one wheel 65 permits a user to tilt the cover device 10 upon the wheel 65 and easily roll the cover device 10. The at least one stop 70 creates a level surface with the wheel 65 when the cover device 10 is in a vertical resting position. The stop 70 and the rigid base 35 permit the cover device 10 to stand alone when containing the golf bag 13.

The cover device 10 also has at least one handle 75 to assist in moving the cover device 10. Additionally, one or more pockets 80 may be located on one or more inner or outer sides of the cover device. These pockets 80 may be used to store miscellaneous smaller golf paraphernalia such as shoes, tees, gloves, etc. The cover device 10 may also have an adjustable carrying strap 85 and a window 90 for an identification tag.

Figure 2:
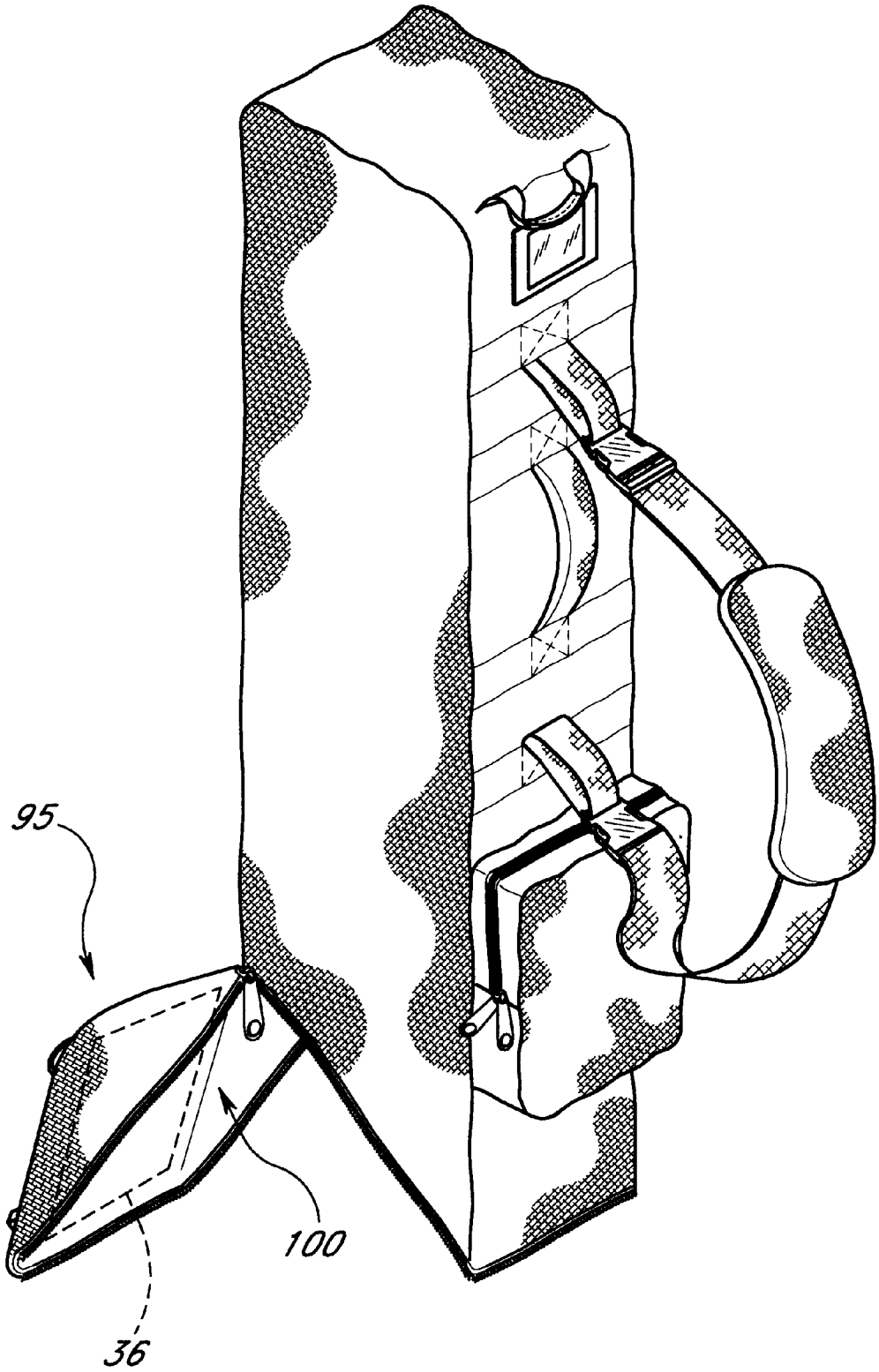
FIG. 2 is a front view of the preferred embodiment with the closure means opened.
Figure 4:
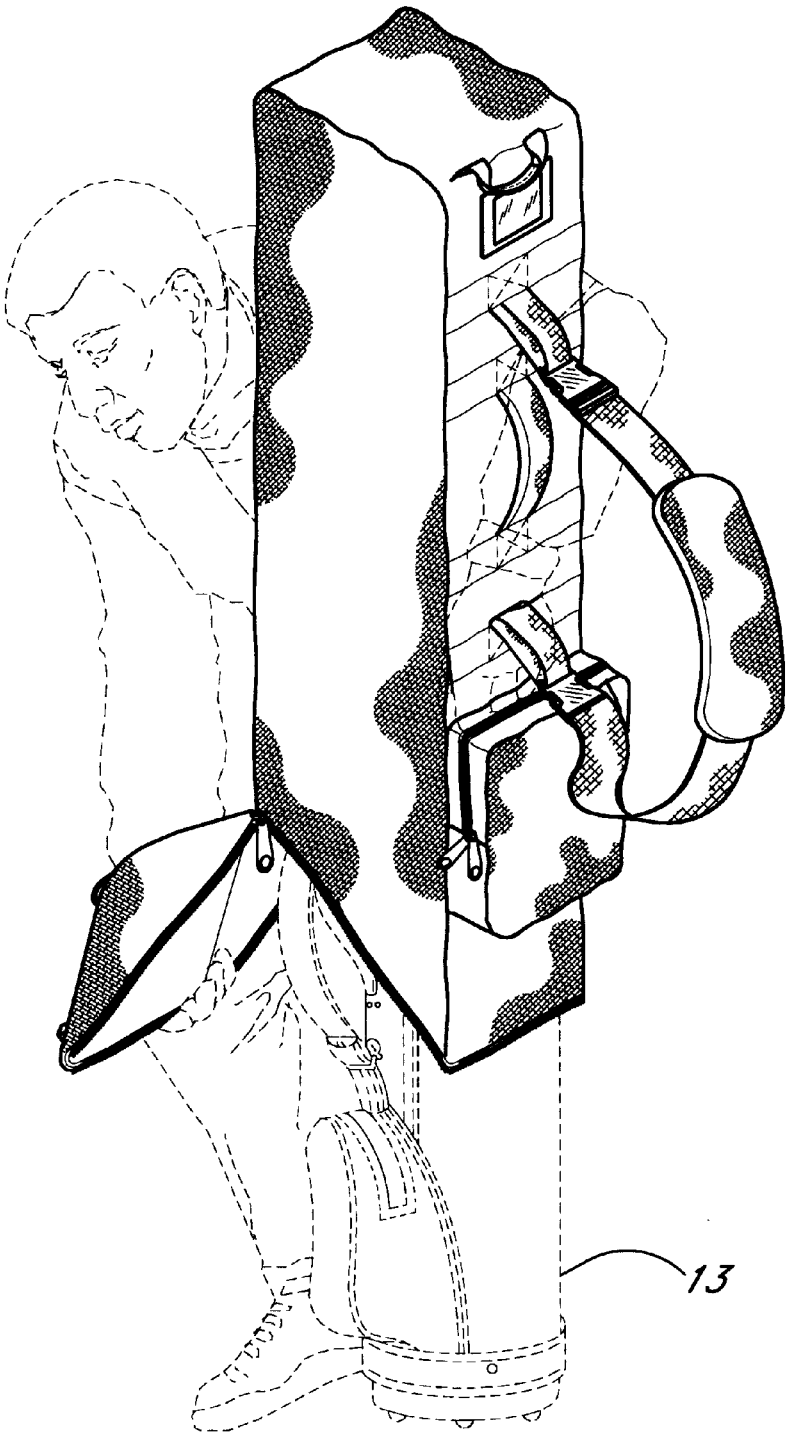
FIG. 4 shows a user sliding the preferred embodiment with the zipper opened over a set of golf clubs in a golf bag.
Figure 5:
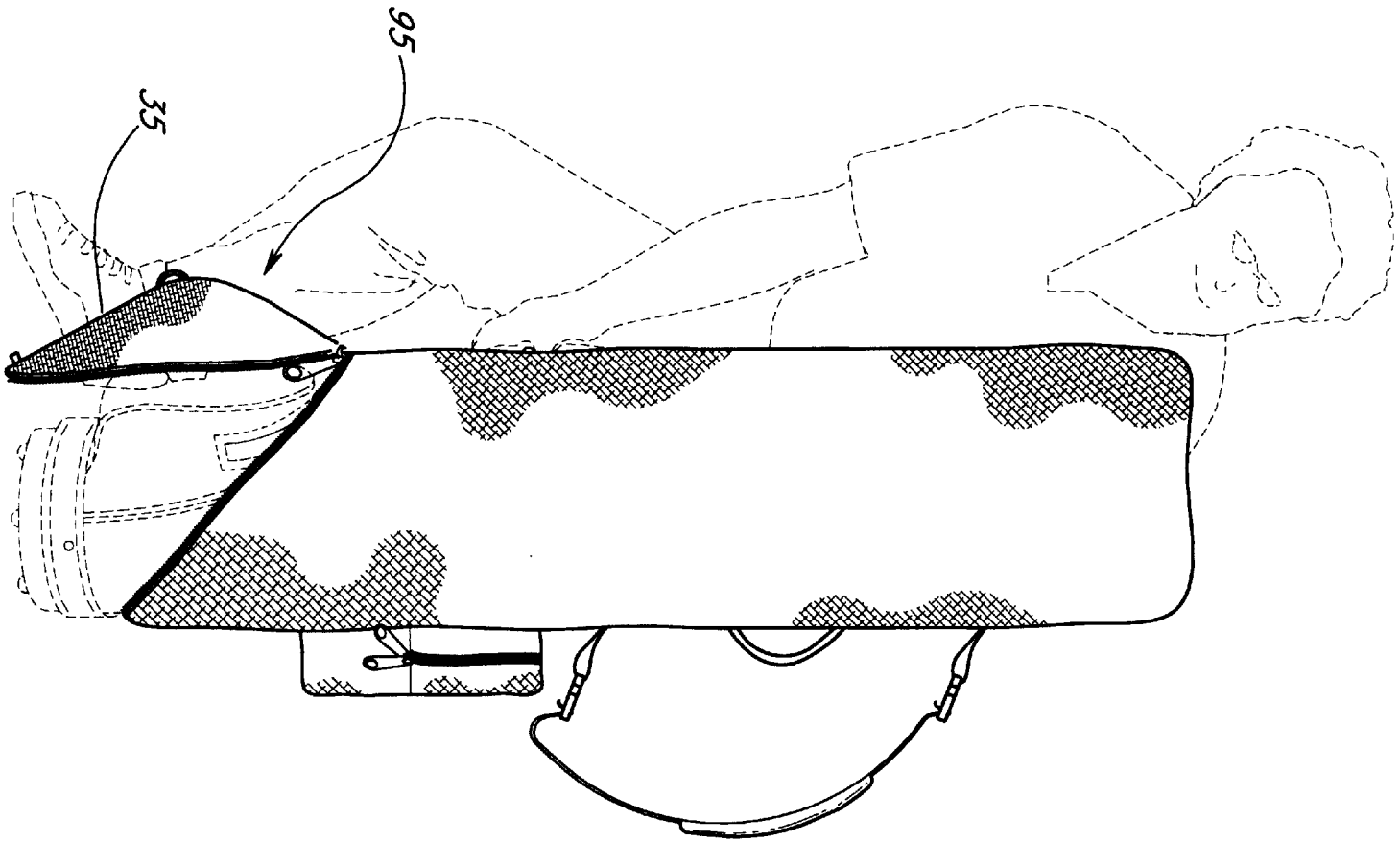
FIG. 5 shows a user pushing the lower rigid back section under the base of the golf bag with his foot.

Referring to FIG. 2, to use the cover device 10, the user opens the slit 40 of the cover device 10 and moves the lower rigid portion 95 comprising the base 35 and bottom half of lower back section 45 away from the remainder of the cover device 10 so as to expose the cover device's interior 100. Next, the user slides the cover device 10 over the golf clubs 12 in the golf bag 13 (see FIG. 4), and then holds onto the cover device 10 while pushing the lower rigid portion 95 towards the golf bag 13, preferably with his or her foot so that the base 35 is pushed under the golf bag 13 (see FIG. 5). The difference in the stiffness between the reinforced rigid lower portion and the flexible portion of said back creates a hinge around which the rigid lower portion swings. Finally, the user closes the slit 40 in the cover device 10. This method of using the cover device 10 advantageously allows the user to conveniently install the cover device 10 onto a golf bag 13 containing golf clubs 12 without having to lift the golf bag 13 into a cover and adjust the cover around the golf bag 13.

Other than the lower rigid portion 95, the cover device 10 may be folded or rolled to a more compact size for storage while no contents are stored therein.

What is claimed is:

1. A bag comprising:

a flexible top connected to a flexible front extending from said flexible top;

two flexible, sides each extending from said flexible top;

a rigid base connected to said sides and front;

a back connected to said sides, top, and base, said back comprising a rigid lower section;

at least one handle located on the bag's exterior;

a means for rolling located under said base;

said front, back, sides, top, and base forming an enclosable container whose height is greater than the container's width or depth;

said sides and said front having a slit continuous along said sides and front, wherein the slit on the front is along the width of the front at or near the base and extends along each of said sides toward the back thereby creating an opening into a storage compartment extending substantially between the top and the base of said bag;

and a closure means for closing said slit, said slit and closure means being located on a lower portion of said bag.

2. The bag of claim 1 wherein the means for rolling consists of at least one wheel.

3. The bag of claim 2 wherein two wheels and a plurality of stops are installed under said base.

4. The bag of claim 3 wherein two stops are installed under said base.

5. The bag of claim 1 wherein the closure means consists of a zipper.

6. The bag of claim 1 wherein the back is bendable above the rigid lower section.

7. The bag of claim 1 wherein the closure means is not contained in a horizontal plane.

8. The bag of claim 1 wherein said bag is padded.

9. The bag of claim 8 wherein the bag's surface near said top is padded.

10. The bag of claim 1 wherein the rigid lower section comprises a reinforcing member.

11. The bag of claim 10 wherein at least one panel is located in the rigid lower section.

12. The bag of claim 10 wherein two adjacent panels are located in the bag's interior.

13. The bag of claim 10 wherein two adjacent panels are located on the bag's exterior.

14. The bag of claim 10 wherein two ribs are vertically aligned and located on the rigid lower section's outer edges.

15. The bag of claim 10 wherein the plurality of ribs are located on the bag's exterior.

16. The bag of claim 10 wherein the plurality of ribs are located on the bag's interior.

17. The bag of claim 1 wherein at least one strap is located on the bag's exterior.

18. The bag of claim 1 wherein a plurality of ribs are located along the rigid lower section's outer edges.

19. The bag of claim 1 wherein said bag is used for storing and transporting a set of golf clubs contained in a golf bag.

20. A bag comprising:

a flexible top connected to a flexible front extending from said flexible top;

two flexible, sides each extending from said flexible top;

a base connected to said sides and front;

a back connected to said sides, top, and base, said back comprising a lower section;

at least one handle located on the bag's exterior;

a means for rolling located under said base;

said front, back, sides, top, and base forming an enclosable container whose height is greater than the container's width or depth;

said sides and said front having a slit continuous along said sides and front, wherein the slit on the front is along the width of the front at or near the base and extends along each of said sides toward the back thereby creating an opening into a storage compartment extending substantially between said top and said base of said bag;

and a closure means for closing said slit, said slit and closure means being located on a lower portion of said bag, said bag further comprising a first rigid portion extending upright when said bag rests on said base on a surface and a second rigid portion which extends along said surface when said bag rests on said surface.

21. The bag of claim 20 wherein the means for rolling consists of at least one wheel.

22. The bag of claim 20 wherein the closure means consists of a zipper.

23. The bag of claim 20 wherein the closure means is not contained in a horizontal plane.

24. The bag of claim 23, wherein said closure means is angled upward toward said back.

25. The bag of claim 20 wherein the rigid lower section comprises a reinforcing member.

26. A method for placing a cover device having an interior and a lower rigid back section and rigid base onto a golf bag comprising the steps of:

opening a slit of said golf bag cover device;

moving the rigid lower back section and rigid base away from the remainder of the cover device so as to expose the interior;

sliding said cover device over the top of the golf bag so as to place the top of the golf bag into the interior;

holding said cover device;

pushing the rigid lower back section of said cover device towards the golf bag so that the base of said cover device is pushed under a base of said golf bag; and closing said slit of the cover device with the golf bag in the interior thereof.

27. The method of claim 26 wherein the opening of the slit comprises unzipping a zipper.

28. The method of claim 26 wherein the closing of said slit of the cover device comprises zipping a zipper.

29. The method of claim 26 wherein the step of pushing the rigid lower back of said cover device comprises pushing with a user's foot.

30. A method for placing a cover device onto a golf bag comprising the steps of:

opening a slit near a base of said golf bag cover device in at least three walls of said cover device;

moving a lower portion defined by said slit and including said base away from said at least three walls so as to expose a storage compartment extending substantially between a top and said base of said cover device;

sliding said cover device over the top of the golf bag so as to place substantially the entire golf bag into the storage compartment;

holding said cover device;

moving said lower portion back toward said at least three walls so that said base of said cover device is positioned under said golf bag; and closing said slit of the cover device with the golf bag in the storage compartment.

31. The method of claim 30 wherein the opening of the slit comprises unzipping a zipper.

32. The method of claim 30 wherein the closing of said slit of the cover device comprises zipping a zipper.

* * * * *